US009630245B2

(12) United States Patent
Furutani et al.

(10) Patent No.: US 9,630,245 B2
(45) Date of Patent: Apr. 25, 2017

(54) CASTING APPARATUS AND CASTING METHOD

(71) Applicant: MAZDA MOTOR CORPORATION, Hiroshima (JP)

(72) Inventors: Kouji Furutani, Hiroshima (JP); Shinichi Kakimoto, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 112 days.

(21) Appl. No.: 14/430,879

(22) PCT Filed: Dec. 5, 2013

(86) PCT No.: PCT/JP2013/007165
§ 371 (c)(1),
(2) Date: Mar. 24, 2015

(87) PCT Pub. No.: WO2014/097565
PCT Pub. Date: Jun. 26, 2014

(65) Prior Publication Data

US 2015/0273574 A1 Oct. 1, 2015

(30) Foreign Application Priority Data

Dec. 19, 2012 (JP) ..... 2012-276519

(51) Int. Cl.
*B22D 17/14* (2006.01)
*B22D 17/20* (2006.01)
(Continued)

(52) U.S. Cl.
CPC ..... *B22D 17/145* (2013.01); *B22C 9/00* (2013.01); *B22D 17/14* (2013.01); *B22D 17/20* (2013.01);
(Continued)

(58) Field of Classification Search
CPC ..... B22D 17/14; B22D 17/145; B22D 17/20; B22D 17/203; B22D 17/22; B22D 17/30
(Continued)

(56) References Cited

U.S. PATENT DOCUMENTS 4,476,911 A 10/1984 Lossack et al.
2009/0194246 A1* 8/2009 Tsuchiya et al. ..... B22D 17/10 164/61
2014/0290893 A1 10/2014 Werner et al.

FOREIGN PATENT DOCUMENTS

CN 201684909 U 12/2010
CN 101954471 A 1/2011
(Continued)

OTHER PUBLICATIONS

An Office Action; "Notification of Reasons for Refusal," issued by the Japanese Patent Office on Apr. 5, 2016, which corresponds to Japanese Patent Application No. 2012-276519 and is related to U.S. Appl. No. 14/430,879, with English language translation.
(Continued)

*Primary Examiner* — Kevin P Kerns
(74) *Attorney, Agent, or Firm* — Studebaker & Brackett PC

(57) ABSTRACT

A casting apparatus is provided with a die; an injection device including a tubular sleeve which communicates with a cavity of the die, and a plunger which injects a molten metal into the cavity; and first and second suction devices, each of which sucks air from the interior of the tubular sleeve. The tubular sleeve communicates with the cavity. The tubular sleeve includes a supply port through which the molten metal is supplied, and an opening which is formed near the supply port for drawing air. The first suction device sucks the air from the interior of the tubular sleeve through the opening. The second suction device sucks the air from the tubular sleeve through a gap between an inner circum-
(Continued)

ferential surface of the tubular sleeve and an outer circumferential surface of the plunger.

7 Claims, 4 Drawing Sheets

(51) Int. Cl.
*B22D 17/22* (2006.01)
*B22C 9/00* (2006.01)
*B22D 17/32* (2006.01)

(52) U.S. Cl.
CPC ..... *B22D 17/203* (2013.01); *B22D 17/22* (2013.01); *B22D 17/32* (2013.01)

(58) Field of Classification Search
USPC ..... 164/61, 253, 254
See application file for complete search history.

(56) References Cited

FOREIGN PATENT DOCUMENTS

| | | | |
|---|---|---|---|
| DE | 3041340 | C2 | 6/1987 |
| DE | 19902063 | B4 | 10/2007 |
| DE | 102007060418 | A1 | 6/2009 |
| DE | 102010046041 | A1 | 4/2011 |
| JP | S61-152375 | U | 9/1986 |
| JP | S61-232050 | A | 10/1986 |
| JP | S62-161449 | A | 7/1987 |
| JP | H02-063665 | A | 3/1990 |
| JP | H08-099161 | A | 4/1996 |
| JP | 2002-346717 | A | 12/2002 |
| JP | 2003-062652 | A | 3/2003 |
| JP | 2004-268051 | A | 9/2004 |
| JP | 2006-000891 | A | 1/2006 |

OTHER PUBLICATIONS

The First Office Action issued by the Chinese Patent Office on Jan. 6, 2016, which corresponds to Chinese Patent Application No. 201380049598.7 and is related to U.S Appl. No. 14/430,879; with English language summary.

International Search Report; PCT/JP2013/007165; Mar. 18, 2014.

An Office Action issued by the German Patent Office on Jul. 12, 2016, which corresponds to German Patent Application No. 112013006075.2 and is related to U.S. Appl. No. 14/430,879, with English language translation.

Nogowizin, Boris; "Theorie und Praxis des Druckgusses" ("Theory and Practice of Die Casting"); Specialist publisher Schiele & Schon; 2011; pp. 228 and 229; Germany.

* cited by examiner

CASTING APPARATUS AND CASTING METHOD

TECHNICAL FIELD

The present invention relates to a casting apparatus and a casting method, and more particularly, to a casting apparatus and a casting method suitable for manufacturing die cast products made of aluminum alloy or the like.

BACKGROUND ART

Conventionally, there is known a casting apparatus for manufacturing die cast products by injecting a molten metal supplied into a tubular sleeve with use of a plunger at a high speed while pressurizing the molten metal, and by pressing the molten metal into a die (cavity) constituted of a fixed die member and a movable die member through a narrow gate. In recent years, vehicle components such as a cylinder block of an engine made of aluminum alloy are manufactured, using the aforementioned casting apparatus.

In the aforementioned casting apparatus, if air is stagnated in the tubular sleeve, the air may be drawn into the die while being trapped in the molten metal. As a result, product defects called blowholes (cast blowholes) may occur. Also, the air in the die may be trapped in the pressurized molten metal, and blowholes may be formed. In view of the above, in the conventional casting apparatus as described above, as disclosed in Patent Literature 1, for instance, air is sucked from the interior of the tubular sleeve through a gap between the tubular sleeve and the plunger, and additionally, air is sucked from the interior of the die for preventing blowholes as described above.

The casting apparatus described in Patent Literature 1 is advantageous in preventing product defects such as blowholes. However, as the degree of vacuum of the interior of the cavity is higher than the degree of vacuum of the interior of the tubular sleeve, a phenomenon called "top molten metal", which may cause product defects (cold shuts), may occur. A top molten metal is a molten metal that is drawn from the interior of the tubular sleeve into the cavity prior to injection.

As a method for preventing a top molten metal, conventionally, air is sucked from the interior of the tubular sleeve and from the interior of the cavity so that the degree of vacuum of the interior of the cavity is lowered than the degree of vacuum of the interior of the tubular sleeve. However, even when the aforementioned operation is performed, if wear of the tubular sleeve or of the plunger progresses, the gap between the tubular sleeve and the plunger increases, which may lead to a negative pressure leakage. This obstructs an increase of the degree of vacuum of the interior of the tubular sleeve, and may cause formation of a top molten metal. In view of the above, in the actual practice, air is sucked from the interior of the cavity so that the degree of vacuum of the interior of the cavity is sufficiently lower than the degree of vacuum of the interior of the tubular sleeve, assuming that wear of the tubular sleeve or the like may progress, for preventing a top molten metal.

In other words, air is sucked from the interior of the tubular sleeve or from the interior of the cavity in order to prevent blowholes. In order to accomplish the above object, it is desirable to increase the degree of vacuum of the interior of the tubular sleeve or of the interior of the cavity. In this case, however, a top molten metal is likely to be formed. On the other hand, when the degree of vacuum of the interior of the tubular sleeve or of the interior of the cavity (in particular, the degree of vacuum of the interior of the cavity) is lowered, formation of blowholes is not sufficiently prevented, although formation of a top molten metal is prevented. Thus, there is a trade-off between preventing a top molten metal and preventing blowholes. In view of the above, it is desirable to solve the aforementioned trade-off problem in order to enhance productivity of cast products, while increasing the yield.

CITATION LIST

Patent Literature

Patent Literature 1: Japanese Unexamined Patent Publication No. 2006-891

SUMMARY OF INVENTION

In view of the above, an object of the invention is to provide a casting apparatus and a casting method that enable to enhance productivity of cast products by significantly preventing blowholes and cold shuts due to a top molten metal.

A casting apparatus of the invention is provided with a die; an injection device including a tubular sleeve which extends in a substantially horizontal direction and communicates with a cavity of the die, and a plunger which injects a molten metal supplied to an interior of the tubular sleeve into the cavity; and a first suction device and a second suction device, each of which sucks air from the interior of the tubular sleeve. The tubular sleeve includes a first end and a second end. The tubular sleeve communicates with the cavity on a side of the first end. The tubular sleeve includes a supply port through which the molten metal is supplied, and an opening which is formed near the supply port on the side of the first end for drawing air. The plunger is movable in the interior of the tubular sleeve between a standby position and a predetermined actuation position, the standby position being such that a tip end of the plunger is located on a side of the second end with respect to the supply port, the plunger being configured to move from the standby position to the actuation position for injecting the molten metal from the interior of the tubular sleeve into the cavity. The first suction device sucks the air from the interior of the tubular sleeve through the opening. The second suction device sucks the air from a first end region of the interior of the tubular sleeve with respect to the tip end of the plunger through a gap between an inner circumferential surface of the tubular sleeve and an outer circumferential surface of the plunger.

Further, a casting method of the invention is a casting method using the casting apparatus having the aforementioned configuration. The casting method includes a first step of moving the plunger from the standby position toward the actuation position at a first speed until the tip end of the plunger reaches a predetermined position between the opening and the first end; and a second step of switching a moving speed of the plunger to a second speed faster than the first speed for moving the plunger to the actuation position. In the first step, sucking the air from the interior of the tubular sleeve is started by the first suction device at a point of time when the tip end of the plunger passes the supply port, and thereafter, sucking the air from the interior of the tubular sleeve is started by the second suction device at a point of time when the tip end of the plunger passes the opening.

DESCRIPTION OF EMBODIMENTS

Figure 1:
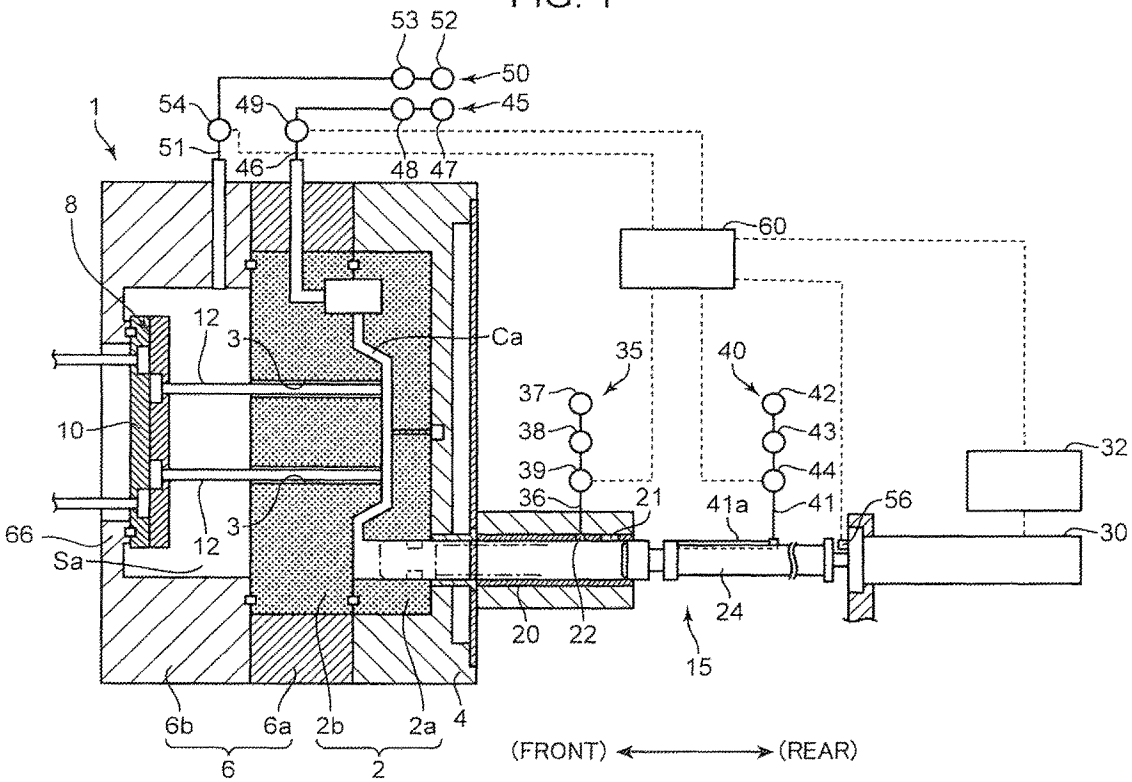
FIG. 1 is a schematic diagram illustrating the overall configuration of a casting apparatus embodying the invention.

An embodiment of the invention is described referring to the drawings.

FIG. 1 is a schematic diagram illustrating the overall configuration of a casting apparatus embodying the invention. The casting apparatus illustrated in FIG. 1 is a so-called cold-chamber casting apparatus configured to mold die cast products made of aluminum alloy or the like. As illustrated in FIG. 1, the casting apparatus is provided with a molding device 1, an extrusion device 8, an injection device 15, and a control device 60 for integrally controlling the devices 1, 8, and 15.

In order to clarify the directional relationships, in the following embodiment, as illustrated in FIG. 1, the left side in FIG. 1 is defined as "front side" of the casting apparatus, and the right side in FIG. 1 is defined as "rear side" of the casting apparatus.

The molding device 1 is a device for substantially manufacturing die cast products. The molding device 1 is provided with a molding die 2; and a fixed base 4 and a movable base 6 for holding the molding die 2.

The molding die 2 is constituted of a fixed die member 2*a* whose position is fixed, and a movable die member 2*b* which is movable relative to the fixed die member 2*a*. The fixed die member 2*a* is supported on the fixed base 4. The movable die member 2*b* is supported on the movable base 6. The movable base 6 is movable in front and rear directions relative to the fixed base 4. In other words, the molding die 2 is opened and closed, as the movable base 6 is moved. As illustrated in FIG. 1, the fixed die member 2*a* and the movable die member 2*b* cooperatively form a cavity Ca in a closed state in which the fixed die member 2*a* and the movable die member 2*b* are placed one over the other. As will be described later in detail, die cast products are manufactured by injecting an aluminum alloy molten metal into the cavity Ca by the injection device 15.

Although not illustrated, the molding device 1 is provided with a movable die driving mechanism including a hydraulic cylinder as a driving source, and a booster mechanism such as a toggle link mechanism. The molding device 1 is configured such that the movable die driving mechanism moves the movable base 6 in front and rear directions, and the booster mechanism increases the pressing force of the hydraulic cylinder for supplying the increased pressing force to the movable die member 2*b* in order to securely keep a closed state of the molding die 2.

The movable base 6 includes a rear base member 6*a* which supports the movable die member 2*b*, and a front base member 6*b* which comes into firm contact with the rear base member 6*a* in an airtight state on the front side of the rear base member 6*a*. The front base member 6*b* has a box shape and extends through the molding device 1 in front and rear directions. A head 10 of the extrusion device 8 is disposed inside the front base member 6*b*.

The extrusion device 8 is configured to dismount a molded die cast product from the molding die 2. The extrusion device 8 includes an unillustrated hydraulic cylinder to be loaded on the front base member 6*b*, the head 10 which is movable in front and rear directions relative to the movable die member 2*b* while being driven by the hydraulic cylinder, and a plurality of separation pins 12 fixed to the head 10 and extending in front and rear directions. Each of the separation pins 12 is inserted in a through-hole 3 formed in the movable die member 2*b* so as to pass through the movable die member 2*b* in front and rear directions. Each of the separation pins 12 is projectable and retractable with respect to the rear side of the movable die member 2*b*, as the head 10 is moved. In other words, the extrusion device 8 is configured such that allowing the separation pins 12 to project rearward of the movable die member 2*b* in a state that the molding die 2 is opened makes it possible to dismount a die cast product held on the movable die member 2*b* from the movable die member 2*b*, utilizing a pushing force of the separation pins 12 against the movable die member 2*b*.

A flange portion 66 extending inward is formed at a front end of the front base member 6*b*. In a state that the head 10 is retracted, the head 10 comes into firm contact with the flange portion 66 (a state illustrated in FIG. 1), whereby an internal space Sa of the front base member 6*b* is isolated from the outside in an airtight state.

Figure 2:
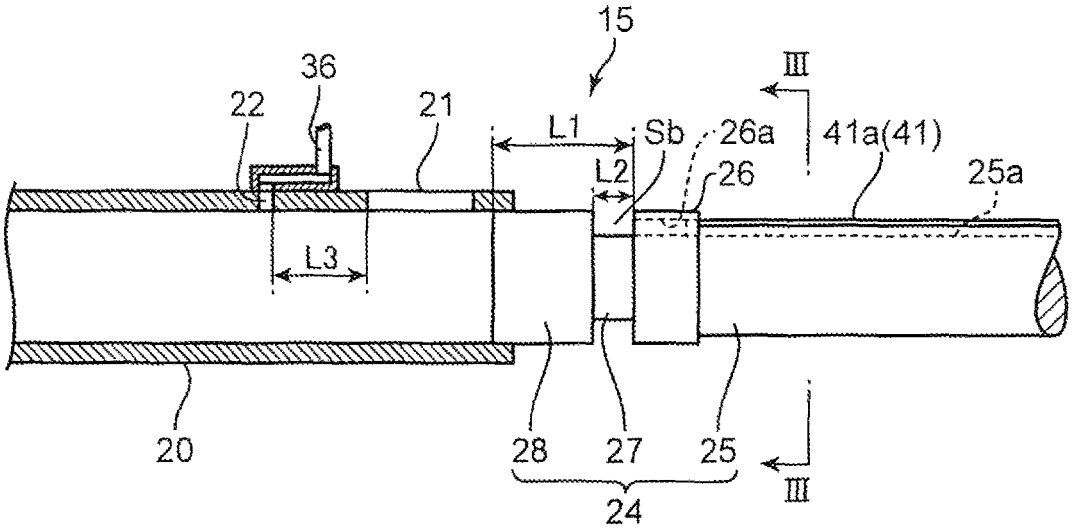
FIG. 2 is a sectional view illustrating essential parts of an injection device.

The injection device 15 is configured to inject an aluminum alloy molten metal into the cavity Ca of the molding die 2. As illustrated in FIG. 1 and FIG. 2, the injection device 15 is provided with a tubular sleeve 20 which temporarily holds a molten metal, a plunger 24 which injects the molten metal from the tubular sleeve 20, a plunger driving mechanism which drives the plunger 24, and a first suction device 35 and a second suction device 40, each of which sucks the air from the interior of the tubular sleeve 20.

The tubular sleeve 20 is a tubular member extending substantially horizontally in front and rear directions. The tubular sleeve 20 is connected to the fixed die member 2*a* in a state that a front end of the tubular sleeve 20 (corresponding to a first end of the invention) is held on the fixed base 4. The tubular sleeve 20 has a supply port 21 through which a molten metal is supplied, and an opening 22 for sucking air (drawing air) in an upper portion of the tubular sleeve 20 near a rear end of the tubular sleeve 20 (corresponding to a second end of the invention). The opening 22 for sucking air has a sufficiently small diameter as compared with the diameter of the supply port 21, and is formed at a front position of the supply port 21.

The plunger 24 is a rod-like member extending in front and rear directions. The plunger 24 is moved in the interior of the tubular sleeve 20 in front and rear directions. The plunger 24 includes a columnar-shaped rod 25, a columnar-shaped injection tip 28 for pressing a molten metal, and a joint 27 for connecting the injection tip 28 to a tip end of the rod 25. The outer diameter of the injection tip 28 is set to be slightly smaller than the inner diameter of the tubular sleeve 20. The rod 25 has a flange portion 26 at a tip end thereof, which is slidably movable on the inner circumferential surface of the tubular sleeve 20. The flange portion 26 has an outer diameter larger than the diameter of the injection tip 28, and has a large thickness in front and rear directions. The outer diameter of the joint 27 is set to be smaller than the diameter of the injection tip 28 and the diameter of the flange portion 26. According to this configuration, a waist portion Sb of the joint 27 is formed at a tip end of the plunger 24.

The plunger 24 and the tubular sleeve 20 are configured such that when the plunger 24 is moved forward from a position illustrated in FIG. 2 (a standby position to be described later), the opening 22 is closed by the injection tip 28 in accordance with the movement, and thereafter, a closed space by the waist portion Sb is formed at a position between the supply port 21 and the opening 22, while keeping the closed state. Specifically, the length L1 from the tip end of the plunger 24 (the tip end of the injection tip 28) to the rear end of the waist portion Sb in front and rear directions is set to be larger than the length L3 between the opening 22 and the supply port 21 (the distance between the opening 22 and the supply port 21), and the length L2 of the waist portion Sb in front and rear direction is set to be smaller than the length L3.

As illustrated in FIG. 1, the plunger driving mechanism includes a hydraulic cylinder 30 for driving the plunger 24, and a hydraulic circuit 32 for feeding and discharging hydraulic oil to and from the hydraulic cylinder 30. Causing the control device 60 to switch valve members of the hydraulic circuit 32 makes it possible to drive the plunger 24 between a standby position (the position illustrated in FIG. 2), in which the tip end of the plunger 24 (the tip end of the injection tip 28) is located on the rear side with respect to the supply port 21, and an actuation position (the position indicated by the one-dotted chain line in FIG. 1), in which the tip end of the plunger 24 reaches a position near the gate of the fixed die member 2*a* through which a molten metal is injected. In particular, when a molten metal is injected, first of all, the plunger driving mechanism drives the plunger 24 at a low injection speed. Then, when the plunger 24 reaches a predetermined speed switching position, the injection speed is switched to a high speed. This control makes it possible to instantaneously inject a molten metal into the cavity Ca and fill the cavity Ca with the molten metal.

A stroke sensor 56 is disposed near an output shaft of the hydraulic cylinder 30. The stroke sensor 56 optically reads a scale formed on the output shaft, and outputs the read data to the control device 60 in order to detect a moving amount of the plunger 24 from the standby position. In other words, the control device 60 detects the speed switching position based on a detection signal from the stroke sensor 56, and controls switching of the injection speed of the plunger 24 by the detection.

The first suction device 35 sucks the air from the interior of the tubular sleeve 20 through the opening 22 formed in the tubular sleeve 20. The first suction device 35 includes a first vacuum passage 36 which communicates with the interior of the tubular sleeve 20 through the opening 22, and also includes a first vacuum pump 37, a first vacuum tank 38, and a first control valve 39 which are disposed in this order from upstream side on the first vacuum passage 36.

On the other hand, the second suction device 40 is configured to suck the air from the interior of the tubular sleeve 20 from the rear side of the injection tip 28 through a gap between the outer circumferential surface of the plunger 24 (specifically, the outer circumference surface of the injection tip 28), and the inner circumferential surface of the tubular sleeve 20. The second suction device 40 includes a second vacuum passage 41, and also includes a second vacuum pump 42, a second vacuum tank 43, and a second control valve 44 which are disposed in this order from upstream side on the second vacuum passage 41.

Figure 3:
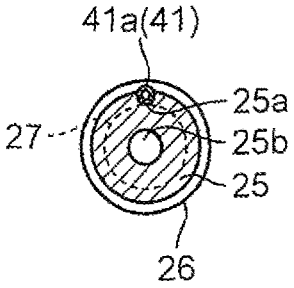
FIG. 3 is a sectional view of a plunger (a sectional view taken along the line III-III in FIG. 2)

A certain tip end region of the second vacuum passage 41 is constituted of a metal suction pipe 41*a* (corresponding to a passage portion of the invention) which is fixed along the plunger 24. As illustrated in FIG. 2 and FIG. 3, a tip end of the suction pipe 41*a* is received in a through-hole 26*a* formed in the flange portion 26 of the rod 25 in front and rear directions, and a rear portion of the suction pipe 41*a* with respect to the receiving portion is fixed to the rod 25 in a state that the rear portion is disposed in a groove 25*a* formed in the outer circumferential surface of the rod 25 in front and rear directions. In other words, as will be described later, the second suction device 40 sucks the air from the interior of a closed space formed by the waist portion Sb through the through-hole 26*a* so as to suck the air from the interior of the tubular sleeve 20 from the rear side of the injection tip 28 through the gap between the inner circumferential surface of the tubular sleeve 20 and the outer circumferential surface of the injection tip 28.

Indicated at the reference sign 25*b* in FIG. 3 is a cooling water passage formed in the rod 25. The cooling water passage 25*b* communicates with an unillustrated cooling water passage formed inside the injection tip 28 and inside the joint 27. In other words, the injection device 15 is configured to supply cooling water to the injection tip 28 through the cooling water passage 25*b* so as to prevent thermal deformation or the like of the injection tip 28.

As illustrated in FIG. 1, the casting apparatus is provided with a third suction device 45 and a fourth suction device 50, each of which sucks air from the internal space of the molding device 1, in addition to the first suction device 35 and the second suction device 40. The third suction device 45 sucks the air from the interior of the cavity Ca. The fourth suction device 50 sucks the air from the internal space Sa of the front base member 6*b*.

The third suction device 45 includes a third vacuum passage 46 which communicates with the cavity Ca at an upper portion of the molding die 2, and also includes a third vacuum pump 47, a third vacuum tank 48, and a third control valve 49 disposed in this order from upstream side on the third vacuum passage 46.

On the other hand, the fourth suction device 50 includes a fourth vacuum passage 51 which communicates with the internal space Sa of the front base member 6*b*, and also includes a fourth vacuum pump 52, a fourth vacuum tank 53, and a fourth control valve 54 disposed in this order from upstream side on the fourth vacuum passage 51.

The control device 60 is constituted of a CPU, an ROM which stores various programs for controlling the CPU, an RAM which temporarily stores various data during an operation, and an HDD. As described above, the control device 60 integrally controls driving of the molding device 1, an extrusion device 8, and the injection device 15. In particular, regarding the controls associated with the invention, the control device 60 controls driving of the plunger 24 in order to inject a molten metal from the tubular sleeve 20 into the cavity Ca, and controls the first suction device 35, the second suction device 40, and the third suction device 45 so as to suck the air from the interior of the tubular sleeve 20 and from the interior of the cavity Ca at a predetermined timing, based on an output signal from the stroke sensor 56 in association with the driving of the plunger 24. The suction timings by the suction devices 35, 40, and 45 are stored in the ROM or in the other storage device.

Figure 4:
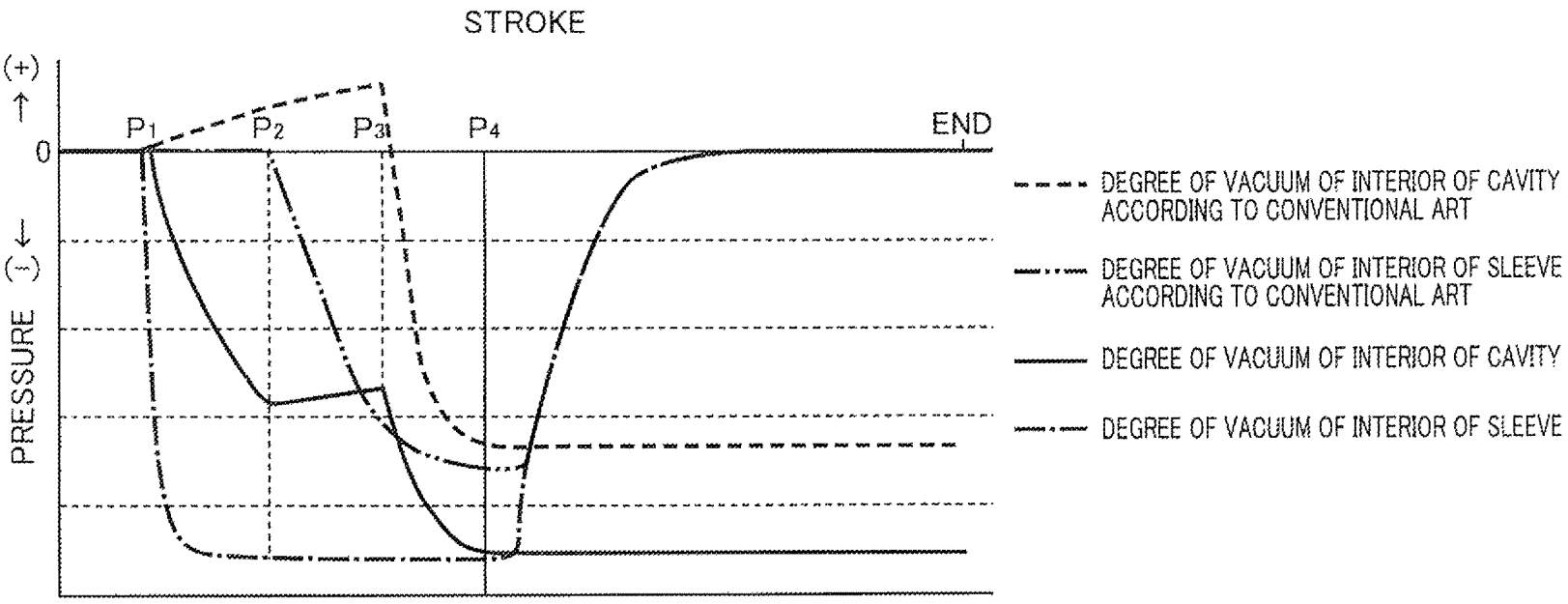
FIG. 4 is a diagram (a timing chart) illustrating a relationship between a moving amount of the plunger from a standby position, and an inner pressure of a cavity and an inner pressure of a tubular sleeve during a casting operation to be performed by an inventive casting apparatus, and during a casting operation to be performed by a conventional casting apparatus.
Figure 5A:
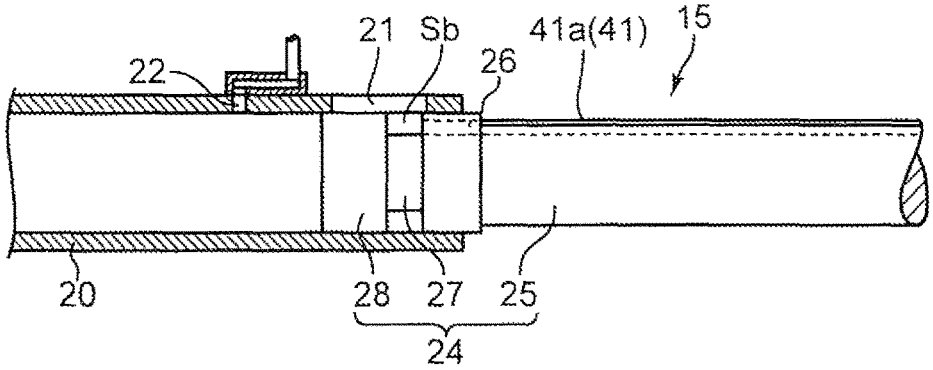
FIG. 5A is a sectional view illustrating essential parts of an injection device, when the injection device performs an injection operation of a molten metal.
Figure 5B:
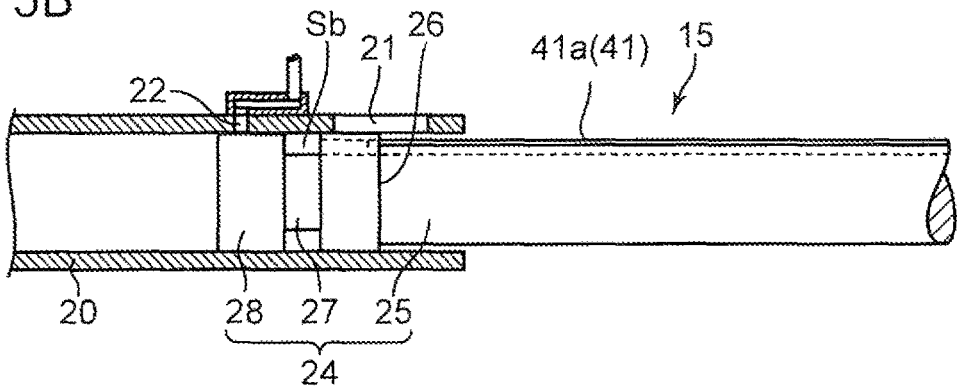
FIG. 5B is a sectional view illustrating essential part of an injection device, when the injection device performs an injection operation of a molten metal.
Figure 5C:
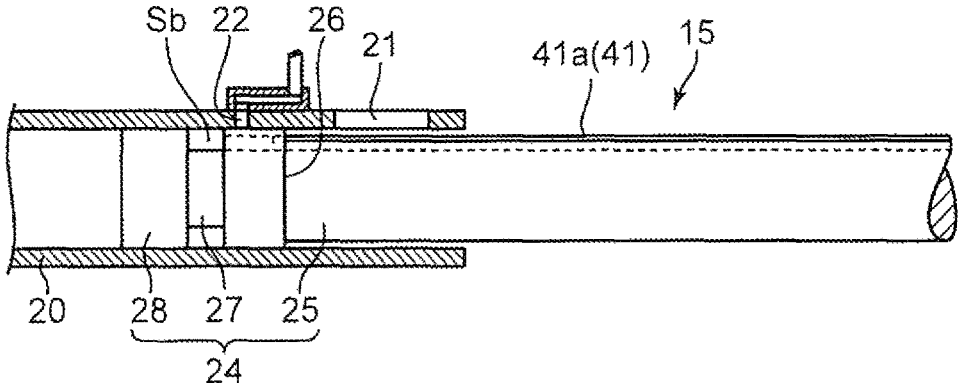
FIG. 5C is a sectional view illustrating essential part of an injection device, when the injection device performs an injection operation of a molten metal.

Next, an injection operation of a molten metal based on control of the control device 60, and advantages of the injection operation are described referring to FIG. 4 to FIG. 5C. A degree of vacuum of the interior of the cavity (indicated by the broken line), and a degree of vacuum of the interior of the tubular sleeve (indicated by the two-dotted chain line) in a conventional apparatus (see Patent Literature 1, namely, Japanese Unexamined Patent Publication No. 2006-891) are also illustrated in FIG. 4.

First of all, the fixed die member 2*a* and the movable die member 2*b* are placed one over the other. By the placement operation, as illustrated in FIG. 1, the cavity Ca is formed in the interior of the molding die 2. When the cavity Ca is formed, the head 10 of the extrusion device 8 is set to a retracted position. By the retracting operation, the internal space Sa of the front base member 6*b* is isolated from the outside in an airtight state. Further, the plunger 24 of the injection device 15 is set to a standby position.

In this state, an aluminum alloy molten metal is supplied into the interior of the tubular sleeve 20 through the supply port 21. When supply of the molten metal is completed, a low-speed injection (corresponding to a first step of the invention) is started by the plunger 24. Specifically, the plunger 24 is driven by the hydraulic cylinder 30, and the plunger 24 is started to move from the standby position to an actuation position at a predetermined low speed.

When the tip end of the plunger 24 (the tip end of the injection tip 28) passes the supply port 21, and the plunger 24 reaches the position where the supply port 21 is closed by the injection tip 28 (see the position P1 in FIG. 5A/FIG. 4), suction of the air from the interior of the tubular sleeve 20 is started by the first suction device 35.

As described above, when air is sucked from the interior of the tubular sleeve 20, the interior of the tubular sleeve 20 is instantaneously brought to a highly vacuum state. Further, as illustrated in FIG. 4, when air is sucked from the interior of the cavity Ca through the tubular sleeve 20 and through the gate, the interior of the cavity Ca is also brought to a vacuum state. When the interior of the tubular sleeve 20 and the interior of the cavity Ca are brought to a vacuum state, a change of the inner pressure of the cavity Ca is slightly slow, as compared with a change of the inner pressure of the tubular sleeve 20, because the inner space of the cavity Ca is sufficiently large, as compared with the space inside the tubular sleeve 20 (the space excluding a portion occupied by the molten metal).

When the opening 22 is closed by the injection tip 28 by passing of the tip end of the injection tip 28 over the opening 22, and when the plunger 24 reaches the position (the position P2 illustrated in FIG. 5B/FIG. 4) where the supply port 21 is closed by the flange portion 26 by passing of the tip end of the rod 25 (the flange portion 26) over the supply port 21, specifically, when a closed space by the waist portion Sb is formed by covering of the waist portion Sb of the plunger 24 from the outside by the tubular sleeve 20, sucking the air from the interior of the tubular sleeve 20 is started by the second suction device 40. More specifically, air is sucked from the inner space formed by the waist portion Sb through the through-hole 26*a* formed in the flange portion 26 and through the suction pipe 41*a*, whereby sucking the air from the interior of the tubular sleeve 20 (from the front region of the interior of the tubular sleeve 20 with respect to the tip end of the plunger 24) is started through the gap between the outer circumferential surface of the injection tip 28 and the inner circumferential surface of the tubular sleeve 20.

As described above, air is sucked from the interior of the tubular sleeve 20 by combined use of the first suction device 35 and the second suction device 40, whereby the vacuum state of the interior of the tubular sleeve 20 is promoted.

Further, when the tip end of the rod 25 (the flange portion 26) passes the opening 22, and the plunger 24 reaches the position where the opening 22 is closed by the flange portion 26 (see the position P3 illustrated in FIG. 5C/FIG. 4), sucking the air from the interior of the cavity Ca is started by the third suction device 45. As sucking the air is started, as illustrated in FIG. 4, the degree of vacuum of the interior of the cavity Ca is increased. In the embodiment, it is possible to increase the degree of vacuum of the interior of the cavity Ca to a degree of vacuum slightly lower than the degree of vacuum of the interior of the tubular sleeve 20.

When the plunger 24 reaches a predetermined speed switching position (the position P4 illustrated in FIG. 4), a high-speed injection (corresponding to a second step of the invention) is started by the plunger 24. Specifically, the driving speed of the plunger 24 by the hydraulic cylinder 30 is switched to a predetermined speed faster than the low injection speed. By the switching operation, the molten metal is instantaneously injected from the tubular sleeve 20 into the cavity Ca through the gate, and the interior of the cavity Ca is filled with the molten metal. Sucking the air from the interior of the tubular sleeve 20 by the first suction device 35 and by the second suction device 40 is stopped at a predetermined timing by controlling the position of the plunger 24. Further, after filling the interior of the cavity Ca with the molten metal is completed, sucking the air from the interior of the cavity Ca by the third suction device 45 is stopped at a predetermined timing.

As described above, according to the casting apparatus (the casting method) as described above, when a molten metal is injected, first of all, air is sucked from the interior of the tubular sleeve 20 by the first suction device 35 through the opening 22 formed in the tubular sleeve 20, and air is sucked from the interior of the cavity Ca by the sucking operation. After the opening 22 is closed by the plunger 24 (the injection tip 28), air is sucked from the interior of the tubular sleeve 20 by combined use of the first suction device 35 and the second suction device 40. According to the casting apparatus (the casting method) as described above, air is directly sucked from the interior of the tubular sleeve 20 through the opening 22. Therefore, as illustrated in FIG. 4, it is possible to advantageously increase the degree of vacuum of the interior of the tubular sleeve 20, and to increase the degree of vacuum of the interior of the cavity Ca through the tubular sleeve 20. This is advantageous in increasing the degree of vacuum of the interior of the tubular sleeve 20 and of the interior of the cavity Ca, whereby it is possible to advantageously prevent blowholes. Further, air is sucked from the interior of the cavity Ca through the tubular sleeve 20. Therefore, it is possible to prevent the degree of vacuum of the interior of the cavity Ca from becoming higher than the degree of vacuum of the interior of the tubular sleeve 20. This is advantageous in preventing formation of a top molten metal.

Further, according to the casting apparatus (the casting method) as described above, after air is sucked from the interior of the tubular sleeve 20 by the first suction device 35 and by the second suction device 40, sucking the air from the interior of the cavity Ca is started at a predetermined timing by the third suction device 45. According to the casting apparatus (the casting method) as described above, it is possible to increase the degree of vacuum of the interior of the cavity Ca to a value close to the degree of vacuum of the interior of the tubular sleeve 20 as much as possible. This is advantageous in securely preventing blowholes. In this case, it is possible to suck the air from the interior of the tubular sleeve 20 by the first suction device 35 at an early stage of low-speed injection by the plunger 24. This is advantageous in preventing the degree of vacuum of the interior of the cavity Ca from becoming higher than the degree of vacuum of the interior of the tubular sleeve 20, whereby it is possible to prevent formation of a top molten metal.

On the other hand, FIG. 4 also illustrates an example of a relationship between suction start timings and degrees of vacuum of the interior of the tubular sleeve and of the interior of the cavity in the conventional casting apparatus (see Patent Literature 1) described in the section of Background Art.

The conventional casting apparatus is configured such that after a low-speed injection by the plunger is started, when the tip end of the flange (corresponding to the flange portion 26) passes the molten metal supply port (indicated by the position P2), sucking the air from the interior of the tubular sleeve is started, and then (at the position P3), sucking the air from the interior of the cavity is started. In the conventional casting apparatus (casting method) as described above, when air is directly sucked from the interior of the cavity at an early stage after a low-speed injection by the plunger is started, as described in the section of Background Art, a top molten metal is formed due to an excess of the degree of vacuum of the interior of the cavity over the degree of vacuum of the interior of the tubular sleeve before the injection is switched to the high-speed injection (see the position P4). In order to avoid this phenomenon, as illustrated in FIG. 4, it is necessary to set the degree of vacuum of the interior of the cavity low, as compared with the degree of vacuum of the interior of the tubular sleeve. Thus, it is difficult to increase the degree of vacuum of the interior of the cavity.

On the other hand, in the casting apparatus (the casting method) of the embodiment, as described above (see FIG. 4), it is possible to increase the degree of vacuum of the interior of the cavity Ca in advance to such a value that does not exceed the degree of vacuum of the interior of the tubular sleeve 20 by directly sucking the air from the interior of the tubular sleeve 20 through the opening 22. In this way, air is sucked from the interior of the cavity Ca in such a way that the degree of vacuum of the interior of the cavity Ca does not exceed the degree of vacuum of the interior of the tubular sleeve 20 before the injection is switched from a low-speed injection to a high-speed injection so as to increase the degree of vacuum of the interior of the cavity Ca. This makes it possible to prevent the degree of vacuum of the interior of the cavity Ca from becoming higher than the degree of vacuum of the interior of the tubular sleeve 20 at an early stage. Thus, the configuration of the embodiment is advantageous in increasing the degree of vacuum of the interior of the tubular sleeve 20 and of the interior of the cavity Ca, while preventing formation of a top molten metal.

Thus, according to the casting apparatus (the casting method) of the embodiment, it is possible to advantageously prevent formation of both of blowholes and cold shuts due to a top molten metal. This is advantageous in enhancing productivity of cast products.

The casting apparatus, and the casting method by the casting apparatus as described above are a preferred example of the casting apparatus and the casting method of the invention. An exemplified configuration of the casting apparatus, and an exemplified casting method may be modified, as necessary, as far as such modifications do not depart form the gist of the invention.

For instance, in the embodiment, the movable die driving mechanism of the molding device 1 drives the movable base 6 (the movable die member 2*b*), while using the hydraulic cylinder as a driving source. Further, the plunger driving mechanism of the injection device 15 drives the plunger 24, while using the hydraulic cylinder 30 as a driving source. Alternatively, these driving mechanisms may be configured to drive the movable base 6 (the movable die member 2*b*), using the other driving source such as a hydraulic motor.

Further, in the embodiment, the control device 60 controls the suction start timings of the suction devices 35, 40, and 45, based on a moving amount of the plunger 24 from a standby position (specifically, controls the suction start timings, based on an output signal from the stroke sensor 56). Alternatively, for instance, the control device 60 may control the suction start timings of the suction devices 35, 40, and 45, based on a lapse of time from the point of time when the plunger 24 starts to move. When the suction start timings are controlled based on a moving amount of the plunger 24, there is no influence due to an error in the moving speed of the plunger 24. In view of the above, it is preferable to control the suction start timings of the suction devices 35, 40, and 45, based on a moving amount of the plunger 24 as described in the embodiment.

Further, in the embodiment, the second suction device 40 is configured to suck the air from an inner space of the waist portion Sb (a closed space formed by the waist portion Sb) through the suction pipe 41*a*. Alternatively, for instance, a suction passage (a passage portion) may be formed in the rod 25 of the plunger 24 to extend in the length direction of the plunger 24 and to open toward the inner side of the waist portion Sb so as to suck the air from the inner space of the waist portion Sb through the air suction passage.

The following is a summary of the embodiment of the invention.

A casting apparatus according to an aspect of the invention is provided with a die; an injection device including a tubular sleeve which extends in a substantially horizontal direction and communicates with a cavity of the die, and a plunger which injects a molten metal supplied to an interior of the tubular sleeve into the cavity; and a first suction device and a second suction device, each of which sucks air from the interior of the tubular sleeve. The tubular sleeve includes a first end and a second end. The tubular sleeve communicates with the cavity on a side of the first end. The tubular sleeve includes a supply port through which the molten metal is supplied, and an opening which is formed near the supply port on the side of the first end for drawing air. The plunger is movable in the interior of the tubular sleeve between a standby position and a predetermined actuation position, the standby position being such that a tip end of the plunger is located on a side of the second end with respect to the supply port, the plunger being configured to move from the standby position to the actuation position for injecting the molten metal from the interior of the tubular sleeve into the cavity. The first suction device sucks the air from the interior of the tubular sleeve through the opening. The second suction device sucks the air from a first end region of the interior of the tubular sleeve with respect to the tip end of the plunger through a gap between an inner circumferential surface of the tubular sleeve and an outer circumferential surface of the plunger.

Further, a casting method according to another aspect of the invention is a casting method using the casting apparatus having the aforementioned configuration. The casting method includes a first step of moving the plunger from the standby position toward the actuation position at a first speed until the tip end of the plunger reaches a predetermined position between the opening and the first end; and a second step of switching a moving speed of the plunger to a second speed faster than the first speed for moving the plunger to the actuation position. In the first step, sucking the air from the interior of the tubular sleeve is started by the first suction device at a point of time when the tip end of the plunger passes the supply port, and thereafter, sucking the air from the interior of the tubular sleeve is started by the second suction device at a point of time when the tip end of the plunger passes the opening.

In the casting method (the casting apparatus) as described above, first of all, in the first step, air is sucked from the interior of the tubular sleeve by the first suction device through the opening for drawing air, and air is sucked from the interior of the cavity through the tubular sleeve, as the sucking operation from the interior of the tubular sleeve progresses. After the tip end of the plunger passes the opening, as the plunger is moved, sucking the air from the interior of the tubular sleeve by the second suction device is added. According to the aforementioned casting method, the air is directly sucked from the interior of the tubular sleeve through the opening, thereby the degree of vacuum of the interior of the tubular sleeve is advantageously increased. Further, the air is also sucked from the interior of the cavity, as the sucking operation from the interior of the tubular sleeve progresses. This makes it possible to increase the degree of vacuum of the interior of the cavity. Thus, the degrees of vacuum of the interior of the tubular sleeve and of the interior of the cavity are advantageously increased. This is advantageous in preventing blowholes. Further, the air is sucked from the interior of the cavity through the tubular sleeve. This prevents the degree of vacuum of the interior of the cavity from becoming higher than the degree of vacuum of the interior of the tubular sleeve. This is advantageous in preventing formation of a top molten metal.

Preferably, the casting apparatus may be further provided with a third suction device which sucks the air from an interior of the cavity.

In the above configuration, in the first step, after sucking the air from the interior of the tubular sleeve is started by the second suction device, sucking the air from the interior of the cavity may be started by the third suction device.

According to the aforementioned casting method, it is possible to increase the degree of vacuum of the interior of the cavity to a value close to the degree of vacuum of the interior of the tubular sleeve as much as possible. This is advantageous in securely preventing blowholes. In this configuration, as described above, starting to suck the air from the interior of the cavity by the third suction device, after starting to suck the air from the interior of the tubular sleeve by the first and second suction devices is advantageous in preventing the degree of vacuum of the interior of the cavity from becoming higher than the degree of vacuum of the interior of the tubular sleeve at an early stage. This makes it possible to prevent formation of a top molten metal.

In the casting apparatus, preferably, the second suction device may include a passage portion integrally formed with the plunger for sucking air, the passage portion extending in a direction substantially parallel to a moving direction of the plunger and being opened at a position near the tip end of the plunger.

According to the aforementioned configuration, it is possible to suck the air from the interior of the tubular sleeve at a position near the tip end of the plunger through the gap between the outer circumferential surface of the plunger and the tubular sleeve. This makes it possible to effectively suck the air from the interior of the tubular sleeve.

In the above configuration, preferably, the plunger may include a waist portion at a position near the tip end of the plunger, a length of the plunger from the tip end thereof to a rear end of the waist portion in the moving direction of the plunger may be set larger than a distance between the opening and the supply port formed in the tubular sleeve, and the passage portion of the second suction device may be opened toward an inside of the waist portion.

According to the aforementioned configuration, when the rear end of the waist portion passes the supply port, as the plunger is moved from the standby position toward the actuation position, the waist portion is covered from the outside by the tubular sleeve, and a closed space is formed by the waist portion. When air is sucked from the closed space by the second suction device, the air is sucked from the interior of the tubular sleeve through the gap between the outer circumferential surface of the plunger and the tubular sleeve. According to this configuration, it is possible to efficiently suck the air from the interior of the tubular sleeve through the gap.

Preferably, the casting apparatus having one of the aforementioned configurations may be further provided with a control device which controls the suction devices. The control device may control the suction devices in such a manner that, as the plunger is moved from the standby position to the actuation position, the control device controls the first suction device to start sucking the air from the interior of the tubular sleeve at a point of time when the tip end of the plunger passes the supply port, and thereafter, the control device controls the second suction device to start sucking the air from the interior of the tubular sleeve at a point of time when the tip end of the plunger passes the opening.

According to the aforementioned configuration, it is possible to automate the casting method as described above. In this configuration, preferably, the control device may control the suction start timings by the suction devices, based on a moving amount of the plunger from the standby position.

According to the aforementioned configuration, it is possible to start sucking operations by the suction devices at an accurate timing, without receiving an influence due to an error in the moving speed of the plunger.

The invention claimed is:

1. A casting apparatus, comprising:

a die;

an injection device including a tubular sleeve which extends in a substantially horizontal direction and communicates with a cavity of the die, and a plunger which injects a molten metal supplied to an interior of the tubular sleeve into the cavity;

a first suction device and a second suction device, each of which sucks air from the interior of the tubular sleeve; and a control device which controls the first suction device and the second suction device, wherein the tubular sleeve includes a first end and a second end, the tubular sleeve communicates with the cavity on a side of the first end, the tubular sleeve includes a supply port through which the molten metal is supplied, and an opening which is formed near the supply port on the side of the first end for drawing air, the plunger is movable in the interior of the tubular sleeve between a standby position and a predetermined actuation position, the standby position being such that a tip end of the plunger is located on a side of the second end with respect to the supply port, the plunger being configured to move from the standby position to the actuation position for injecting the molten metal from the interior of the tubular sleeve into the cavity, the first suction device sucks the air from the interior of the tubular sleeve through the opening, the second suction device sucks the air from a first end region of the interior of the tubular sleeve with respect to the tip end of the plunger through a gap between an inner circumferential surface of the tubular sleeve and an outer circumferential surface of the plunger, the control device controls the first suction device and the second suction device in such a manner that as the plunger is moved from the standby position to the actuation position, the control device controls the first suction device to start sucking the air from the interior of the tubular sleeve at a point of time when the tip end of the plunger passes the supply port, and the control device controls the second suction device to start sucking the air from the interior of the tubular sleeve after the tip end of the plunger passes the opening.

2. The casting apparatus according to claim 1, further comprising:

a third suction device which sucks the air from an interior of the cavity.

3. The casting apparatus according to claim 1, wherein the second suction device includes a passage portion integrally formed with the plunger for sucking air, the passage portion extending in a direction substantially parallel to a moving direction of the plunger and being opened at a position near the tip end of the plunger.

4. The casting apparatus according to claim 3, wherein the plunger includes a waist portion at a position near the tip end of the plunger, a length of the plunger from the tip end thereof to a rear end of the waist portion in the moving direction of the plunger is set larger than a distance between the opening and the supply port formed in the tubular sleeve, and the passage portion of the second suction device is opened toward an inside of the waist portion.

5. The casting apparatus according to claim 1, wherein the control device controls suction start timings by the first suction device and the second suction device, based on a moving amount of the plunger from the standby position.

6. A casting method using the casting apparatus of claim 1, comprising:

a first step of moving the plunger from the standby position toward the actuation position at a first speed until the tip end of the plunger reaches a predetermined position between the opening and the first end; and a second step of switching a moving speed of the plunger to a second speed faster than the first speed for moving the plunger to the actuation position, wherein in the first step, sucking the air from the interior of the tubular sleeve is started by the first suction device at a point of time when the tip end of the plunger passes the supply port, and sucking the air from the interior of the tubular sleeve is started by the second suction device after the tip end of the plunger passes the opening.

7. A casting method using the casting apparatus of claim 2, comprising:

a first step of moving the plunger from the standby position toward the actuation position at a first speed until the tip end of the plunger reaches a predetermined position between the opening and the first end; and a second step of switching a moving speed of the plunger to a second speed faster than the first speed for moving the plunger to the actuation position, wherein in the first step, sucking the air from the interior of the tubular sleeve is started by the first suction device at a point of time when the tip end of the plunger passes the supply port, sucking the air from the interior of the tubular sleeve is started by the second suction device after the tip end of the plunger passes the opening, and thereafter, sucking the air from the interior of the cavity is started by the third suction device.

* * * * *